US006385945B1

(12) United States Patent
Hähnel

(10) Patent No.: US 6,385,945 B1
(45) Date of Patent: May 14, 2002

(54) PACKAGING MACHINE

(75) Inventor: Bernd Hähnel, Stutensee (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 09/559,558

(22) Filed: Apr. 27, 2000

(30) Foreign Application Priority Data

May 5, 1999 (DE) ..... 199 20 614

(51) Int. Cl.[7] ..... B65B 51/10

(52) U.S. Cl. ..... 53/377.2; 53/252; 53/382.2; 53/382.3; 53/377.2

(58) Field of Search ..... 53/374, 375, 377.2, 53/376.4, 376.3, 377.6, 382.2, 382.3, 252, 306, 328, 323, 225; 493/80, 81, 183, 166, 177, 449

(56) References Cited

U.S. PATENT DOCUMENTS

| | | | | |
|---|---|---|---|---|
| 3,333,396 A | | 8/1967 | Paal | |
| 3,821,874 A | * | 7/1974 | Jones | 53/27 |
| 3,879,920 A | * | 4/1975 | Langen | 53/63 |
| 3,992,857 A | * | 11/1976 | Giacomelli et al. | 53/306 |
| 4,159,610 A | | 7/1979 | Langen | |
| 4,805,375 A | * | 2/1989 | Langen et al. | 53/142 |
| 5,175,976 A | * | 1/1993 | Petry et al. | 53/252 |

FOREIGN PATENT DOCUMENTS

| | | |
|---|---|---|
| AT | 311 894 | 12/1973 |
| CH | 3 79 379 | 8/1964 |
| DE | 20 32 184 | 2/1971 |
| DE | 34 17 156 | 1/1986 |
| GB | 12 49 389 | 10/1971 |

* cited by examiner

*Primary Examiner*—Rinaldi I. Rada
*Assistant Examiner*—Thanh K. Truong
(74) *Attorney, Agent, or Firm*—Paul Vincent

(57) ABSTRACT

A packaging machine comprises a package transporting means, in particular a folding box transporting means, and a transverse pushing device comprising a plunger which can be displaced substantially perpendicularly to the transport direction of the package transporting means, by means of which a package disposed on the package transporting means can be displaced perpendicularly to the transport direction. Several plungers are thereby displaceably disposed at equal distances on an endless transport device circulating substantially parallel with respect to the transport direction of the package transporting means, wherein a cam track defines the displacement of the plungers and comprises a first section for axial extension of the plunger and a subsequent second section for axial retraction of the plunger. To enable simple and quick adaptation to the format of the folding box to be displaced, at least the first section of the cam track is formed by an adjustable abutment surface on which a first roller travels.

12 Claims, 1 Drawing Sheet

PACKAGING MACHINE

This application claims Paris Convention priority of DE 199 20 614 filed May 5, 1999 the complete disclosure of which is hereby incorporated by reference.

BACKGROUND OF THE INVENTION

The invention concerns a packaging machine comprising a package transporting means, in particular a folding box transporting means, and a transverse pushing means comprising a plunger which can be displaced substantially perpendicularly to the transport direction of the package transporting means, by means of which a package disposed on the package transporting means can be displaced perpendicularly to the transport direction, wherein the plunger is displaceably borne on an endless transporting means circulating substantially parallel to the transport direction of the package transporting means and at the same speed, wherein a cam track defines the displacement of the plunger and comprises a first section for axial extension of the plunger and a subsequent second section for axial retraction of the plunger.

A packaging machine for packaging a product into a folding box usually comprises an endless circulating package transporting means, e.g. a so-called folding box chain, and an endless circulating transport device for the products, e.g. a so-called product chain. The motion of the folding box chain and that of the product chain are synchronized for insertion of the product into the folding box transverse to the direction of motion of the chains.

Before inserting the products, a preceding operation ensures that the side closure flaps of the folding box on the inserting side of the product do not impede the inserting motion. This is usually achieved by displacing the folding boxes, disposed on the folding box chain, transverse to the transport direction of the folding box chain and one after another by using a plunger of a transverse pushing device, wherein the side closure flaps disposed on the inserting side of the product abut against guiding stops and are sidewardly displaced. Since the folding box has a relatively unstable shape during transverse displacement due to the open sideward closure flaps, abutment of the plunger against the folding box must be highly accurate. Matching of the axial extension and retraction of the plunger to the transverse transport motion of the folding box to be displaced is very difficult and frequently causes problems.

After transverse displacement of a folding box by the plunger, the plunger returns to its retracted original position from which it is again extended to transversely displace the next folding box. This reciprocating motion of the plunger requires a relatively large amount of time and substantially limits the cycle frequency and thus the overall output of the packaging machine.

U.S. Pat. No. 4,159,610 discloses a plunger, borne for displacement on an endless circulating transport device comprising chains extending substantially parallel to the transport device of the package transporting means. The transport device has transverse grooves disposed in regular intervals, in which transverse pushing elements (acting as plungers) are displaceably accommodated. Each plunger comprises a roller travelling in a guiding rail forming a cam track for defining the displacement of the plunger. The plunger exerts a pushing or extending motion perpendicular to the transport device and a correspondingly opposite retraction and is also displaced through a section, together with the transport device, parallel to the package transporting means in the transport direction, wherein the transport device and the package transporting means are preferably moved at the same speed to prevent relative displacement between the plunger and the package in the transport direction during the time at which the plunger moves, together with the transport device, parallel to the package transporting means. During motion in the transport direction, the plunger follows the cam track which determines the axial displacement, i.e. extension and retraction of the plunger.

At the end of the endless circulating transport device, the plunger returns to its original position opposite to the transport direction of the package transporting means and can therefore initiate transverse displacement of another package on the package transporting means.

The transport device comprises a toothed belt or a chain having, at an outer side thereof, a guiding part for the plunger in which it is accommodated for axial displacement.

The design of the transport device as an endless belt or strap extending parallel to the package transporting means permits the mounting of several equally spaced guiding parts, each having one plunger, on the belt or strap or on the transport device, to thereby increase the output of the packaging machine.

The cam track defining axial adjustment or displacement of the plunger comprises a first section for the axial extension of the plunger and a second subsequent section for the axial retraction of the plunger, each formed by a section of the guiding rail. To adjust the axial extension of the plunger for displacement with a different folding box format, the entire guiding rail must be removed and replaced. This makes format changes time-consuming and expensive.

It is the underlying purpose of the present invention to provide a transverse pushing device in a packaging machine of the mentioned kind which permits simple and rapid adjustment to the format of the folding box to be displaced.

SUMMARY OF THE INVENTION

This object is achieved in a packaging machine of the above mentioned kind by providing at least the first section of the cam track with an adjustable abutment surface on which a first roller travels. The initial position of the plunger and/or its axial extension can thereby be adjusted to the format of the folding boxes to be displaced.

Simple adjustment of the first section of the cam track can be achieved by forming the adjustable abutment surface from a spring steel plate which can be elastically deformed.

The second section of the cam track which determines the axial retraction of the plunger must not normally be adjusted to the respective folding box size. This second section is therefore preferably formed by a stationary guide, in particular, in the shape of a guiding groove in which the first roller runs.

Smooth, continuous transition must be ensured between the first section of the cam track formed by the spring steel plate and the second section of the cam track formed by the guiding groove. This is achieved in accordance with the invention in that the spring steel plate is mounted in the transition region between the first section and the second section of the cam track such that the surface of the spring steel plate always passes over smoothly into a wall of the guiding groove even when the spring steel plate is adjusted, wherein the spring steel plate accepts the axial motion caused by the adjustment. For adjustment of the spring steel plate, the initial region of the first section of the cam track opposite the retained end is borne on a holder, adjustable in the axial direction of the plunger.

Adjustment of the holder in the axial direction of the plunger changes the initial region of the first section of the cam track, i.e. of the spring steel plate, which leads to deformation of the spring steel plate, since it is fixed at its other end. This guarantees a continuous abutment surface in the first section of the cam track for all adjustment positions.

The extension and retraction of the plunger is preferably carried out via the first and second sections of the cam track when the plunger is located proximate the upper transport region of the endless circulating transport device. At the end of retraction the plunger is at the end of the upper transport region of the transport device and is deflected during further motion to move along the lower transport region and back to the beginning of the upper transport region. During this return motion in the lower transport region, the plunger is controlled in a third section of the cam track which guides the plunger during return motion of the circulating transport device. This third section is preferably formed on the spring steel plate such that, in the transition region between the lower transport region and the upper transport region, a continuous abutment surface is provided on a uniform spring steel plate. The spring steel plate is retained or clamped in a transition region between the guiding groove forming the second section of the cam track and the subsequent third section of the cam track to achieve secure mounting of the spring steel plate with the third section being borne on the holder at its opposite end region. The third section of the cam track preferably passes over smoothly into its first section, It is advantageous to use two rollers for following the cam track during the extension of the plunger and during the return motion of the circulating transport device. The invention thereby provides that a first roller follows the first and third sections of the cam track on one side of the spring steel plate and a second roller seats on the opposite side of the spring steel plate. In this fashion, the axial displacement or position of the plunger is reliably defined. The second section of the cam track, i.e. in the guiding groove provides engagement for the first roller only and precisely defines the axial adjustment motion of the plunger.

The transport device is preferably a toothed belt whose outer side bears a guiding part for the plunger and comprises several equally distanced plungers.

Further embodiments and features of the invention can be extracted from the following description of an embodiment with reference to the accompanying drawings.

DESCRIPTION OF THE PREFERRED EMBODIMENT

Figure 1:
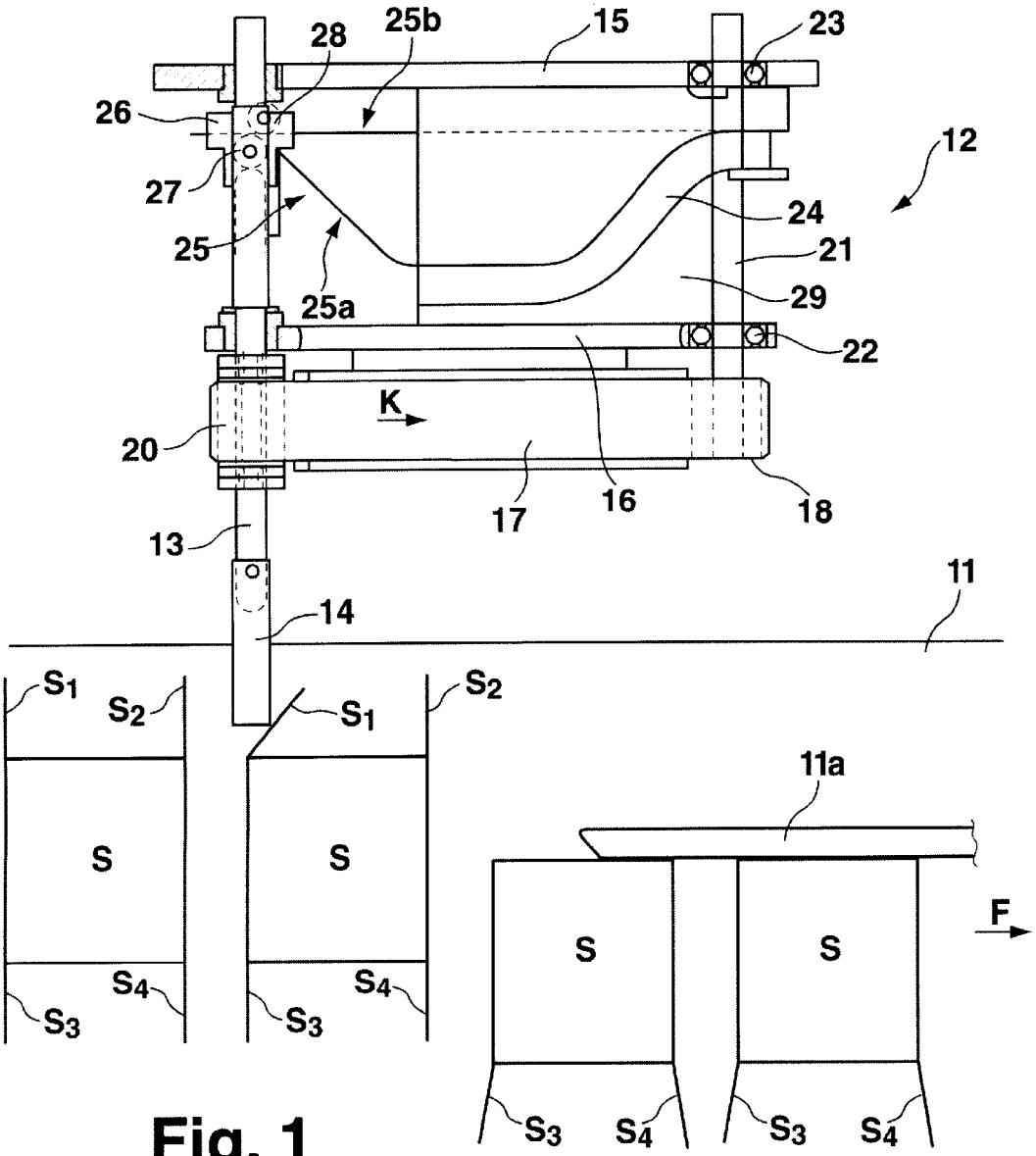
FIG. 1 shows a view of a transverse pushing device of a packaging machine in accordance with the invention.
Figure 2:
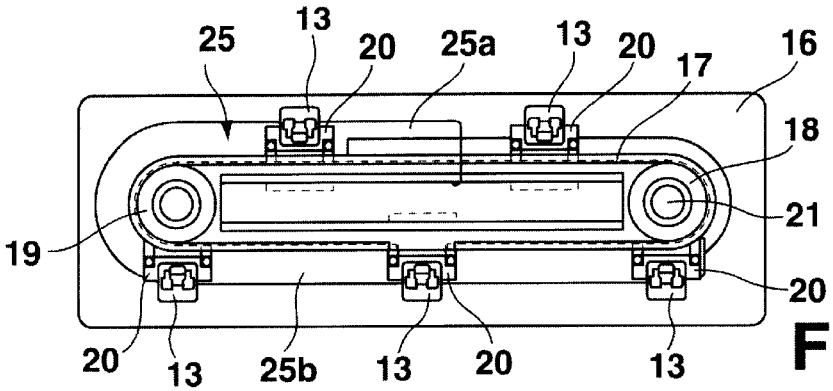
FIG. 2 shows a side view of a transverse pushing device in accordance with the invention.

A packaging machine, shown in sections in FIGS. 1 and 2, comprises a conventional folding box transporting means 11 driven in the transport direction F and supporting, on its upper side, a plurality of folding boxes S which are oriented with their open sides and associated side closure flaps S1, S2 and S3, S4 transverse to the transport direction F. A product (not shown) is inserted into each folding box S from below (as seen in FIG. 1). Prior to product insertion, the side closure flaps S3 and S4 at the product insertion side must be spread outwardly to the side or displaced to free the opening. This is done using a transverse pushing device 12 disposed on the side of the folding box transporting means 11 facing away from the product insertion side which displaces the folding boxes, one after the other, transverse to the transport direction F, to thereby deflect the side closure flaps S3 and S4 in an outward sideward direction through abutment on stops (not shown).

The transverse pushing device 12 comprises an endless circulating transport mechanism in the form of a toothed belt 17 guided by two separated deflection rollers 18, 19 and extending parallel to the folding box transporting means 11. One deflection roller 18 is connected to a drive shaft 21 pivotably borne in separated bearing plates 15, 16 via bearings 22, 23 and is driven in a manner not shown. The toothed belt 17 is driven in the direction U such that the upper transporting region is moved synchronously with the folding box transporting means 11 in the transport direction F, while the lower transporting region travels in the opposite direction.

Five holders 20 are mounted to the outside of the toothed belt 17, equally spaced apart from one another (see FIG. 2), of which only one is shown in FIG. 1 for reasons of clarity. The holders 20 circulate with the toothed belt 17 and bear one plunger 13 each such that same can be displaced axially, i.e. perpendicularly to the direction of travel U of the toothed belt 17 and therefore perpendicularly to the transport direction F of the folding box transporting means 11. The front end of the plunger 13 facing the folding box transporting means 11 comprises a cushion 14 with which it abuts on the folding boxes S.

A first roller 27 and a second roller 28 are rotatably borne at the rear end of each plunger 13 and roll on a cam track (described below) for controlling the axial extension of the plunger 13 in the direction of the folding boxes S as well as its axial retraction. The cam track comprises a first section for the axial extension of the plunger 13, a subsequent second section for the axial retraction of the plunger and a third section for guiding the plunger during return motion of the associated holder 20 in the area of the lower transporting region of the toothed belt 17. The second section of the cam track comprises a guiding groove 24 formed in a plate 29 in which the first roller 27 can be displaced with close tolerance. The guiding groove 24 extends from a position proximate to the toothed belt 17 at its front end to a more remote position at its rear end to thereby move the first roller 27 away from the toothed belt 17 when moving through the guiding groove 24 to retract the plunger 13.

The first section and the third section of the cam track are formed by an substantially U-shaped spring steel plate 25, wherein the two legs of the U-shape have different lengths The front end of the shorter U-shape leg 25*a* is mounted to the plate 29 in such a fashion that a smooth, continuous transition between the surfaces of the U-shape leg 25*a* and the wall of the guiding groove 24 is formed. The U-shape leg 25*a* thereby extends from a position spaced away from the toothed belt 17, diagonally up to the transition to the guiding groove 24 such that the first roller 27 which abuts the U-shape leg 25*a* on the side facing the plunger 13, and the second roller 28 which abuts the opposite side of the U-shape leg 25*a*, are displaced towards the supporting belt 17 when they roll along the first section of the U-shape leg 25*a* of the spring steel plate 25 forming the first section of the cam track, thereby extending the plunger 13 towards the folding boxes S of the folding box transporting means 11.

The free end of the longer U-shape leg 25*b* of the spring steel plate 25 is mounted proximate the end of the guiding groove 24. The deflection or base section of the spring steel plate 25 connecting the two U-shape legs 25*a* and 25*b* is mounted to a member 26 which can be displaced in the direction of motion of the plunger 13 to adjust the cam track through deformation of the spring steel plate 25. The toothed belt 17 and the folding box transporting means 11 are driven substantially at the same speed and in the same direction. When the supporting belt 17 and thus the holder 20 move in the travel direction U, the first roller 27 and the second roller 28 are guided along the inclined U-shaped leg 25*a* of the spring steel plate 25 forming the first section of the cam track. The plunger 13 thereby extends towards the folding box S located on the folding box transporting means 11 The cushion 14 of the plunger 13 abuts against the trailing side closure flap S1 and presses it down into its closing position (indicated in FIG. 1). In a further axial extension of the plunger 13, the folding box S is displaced perpendicularly to the transport direction F on the folding box transporting means 11, thereby deflecting the side closure flaps S3 and S4 facing away from the plunger 13, in a sideward, outward direction via abutment on stops (not shown). In accordance with FIG. 1, the folding box S is displaced downwardly on the folding box transporting means 11 to such an extent that the side closure flaps S1 and S2 facing the transverse pushing device sink below a guiding strip 11*a* and are thus retained in their closed position in a conventional fashion. The guiding strip 11*a* also serves as a support during insertion of the product (not shown) at the opposite side of the folding box S.

The first roller 27 enters the guiding groove 24 in the plate 29 at the end of the first section of the cam track defined by the U-shape leg 25*a* of the spring steel plate 25, thereby withdrawing the plunger 13 during further motion of the toothed belt 17 and of the holder 20 in the travel direction U which reach their maximum retracted position at the end of the guiding groove 24. This corresponds with the end of the upper transport region of the circulating toothed belt 17. The holder 20 is then deflected with the toothed belt 17 about the deflection roller 18 towards the bottom to the lower transport region and returns on same opposite to the transport direction F, wherein, during this motion along the lower transport region of the toothed belt 17, the plunger 13 abuts with its first roller 27 on the front surface, and with its second roller 28 on the rear surface of the longer U-shape leg 25*b* of the spring steel plate 25 to thereby prevent undesired axial displacement. At the end of the lower transport region of the toothed belt 17, the long U-shape leg 25*a* passes over continuously into the other U-shape leg 25*a* along the deflection or base region of the spring steel plate 25 with associated motion about the deflection roller 19, between the lower transport region and the upper transport region of the toothed belt 17, whereupon the holder 20 is returned to the beginning of the first section of the cam track, as shown in FIG. 1.

When (see FIG. 2) five holders 20, each having one plunger 13, are mounted to the outside of the supporting belt 17, the packaging machine can achieve a considerably shorter cycle time compared to conventional linear reciprocating motion of one individual plunger.

I claim:

1. A packaging machine for transporting, displacing, and adjusting a package, the machine comprising:

a package transporting means bearing and transporting the package in a transport direction at a transport speed;

a transverse pushing support disposed proximate said package transporting means;

an endless transport device mounted to said transverse pushing support and circulating substantially parallel to said transport direction of said package transporting means at said transport speed;

a cam track mounted to said transverse pushing support, said cam track having a first section extending towards said packaging transport means and a second section extending away from said package transport means, said first section having an adjustable abutment surface;

a plunger mounted to said endless transport device and borne for axial displacement thereon in a direction substantially perpendicular to said transport direction, said plunger having a first roller communicating with said first section for axial extension of said plunger towards the package, said plunger communicating with said second section for axial retraction of said plunger away from the package; and means, mounted to said transverse pushing support and communicating with said first section, for adjusting a shape and travel of said abutment surface to change an extension motion of said plunger towards the package.

2. The packaging machine of claim 1, wherein said adjustable abutment surface comprises a plate which can be elastically deformed.

3. The packaging machine of claim 1, wherein said second section comprises a stationary guide.

4. The packaging machine of claim 3, wherein said stationary guide defines a guiding groove.

5. The packaging machine of claim 1, wherein said endless transport device comprises a toothed belt having, on an outer side thereof, a guiding part for displaceable acceptance of said plunger.

6. The packaging machine of claim 1, further comprising a plurality of plungers mounted to said endless transport device at equal separations from each other.

7. A packaging machine for transporting, displacing, and adjusting a package, the machine comprising:

a package transporting means bearing and transporting the package in a transport direction at a transport speed;

a transverse pushing support disposed proximate said package transporting means;

an endless transport device mounted to said transverse pushing support and circulating substantially parallel to said transport direction of said package transporting means at said transport speed;

a cam track mounted to said transverse pushing support, said cam track having a first section extending towards said packaging transport means and a second section extending away from said package transport means, said first section having an adjustable abutment surface; and a plunger mounted to said endless transport device and borne for axial displacement thereon in a direction substantially perpendicular to said transport direction, said plunger having a first roller communicating with said first section for axial extension of said plunger towards the package, said plunger communicating with said second section for axial retraction of said plunger away from the package, wherein said adjustable abutment surface comprises a plate which can be elastically deformed, said plate being mounted to a transition region between said first section and said second section of said cam track and being borne at an opposite, initial region of said first section on a holder which can be adjusted in a direction of motion of said plunger.

8. The packaging machine of claim 7, wherein said cam track comprises a third section for guiding said plunger during a return motion of said endless transport device.

9. The packaging machine of claim 8, wherein said third section is formed on said plate.

10. The packaging machine of claim 9, wherein said plate is mounted at a transition region between said second section and said third section of said cam track and is borne on said holder at an opposite end region of said third section.

11. The packaging machine of claim 10, wherein said third section of said cam track passes smoothly into said first section thereof.

12. The packaging machine of claim 11, wherein said first roller follows said cam track in said first and said second sections, said plunger further comprising a second roller communicating with said third section of said cam track.

* * * * *